US011946324B2

(12) United States Patent
Violante Ferreira et al.

(10) Patent No.: US 11,946,324 B2
(45) Date of Patent: Apr. 2, 2024

(54) SUPPORT FOR RISERS AND METHOD FOR COUPLING AND UNCOUPLING

(71) Applicant: Petróleo Brasileiro S.A. - Petrobras, Rio de Janeiro (BR)

(72) Inventors: Claudio Violante Ferreira, Rio de Janeiro (BR); Bruno Pinho Dos Reis, Rio de Janeiro (BR); Flavio Barroso De Mello, Rio de Janeiro (BR)

(73) Assignee: Petróbras Brasileiro S. A.—Petrobras, Rio de Janeiro (BR)

( * ) Notice: Subject to any disclaimer, the term of this patent is extended or adjusted under 35 U.S.C. 154(b) by 0 days.

(21) Appl. No.: 17/926,874

(22) PCT Filed: May 20, 2021

(86) PCT No.: PCT/BR2021/050217
§ 371 (c)(1),
(2) Date: Nov. 21, 2022

(87) PCT Pub. No.: WO2021/232131
PCT Pub. Date: Nov. 25, 2021

(65) Prior Publication Data

US 2023/0228159 A1 Jul. 20, 2023

(30) Foreign Application Priority Data

May 21, 2020 (BR) ..... 10 2020 010231 1

(51) Int. Cl.
*E21B 19/10* (2006.01)
*E21B 19/00* (2006.01)

(52) U.S. Cl.
CPC ..... *E21B 19/10* (2013.01); *E21B 19/004* (2013.01)

(58) Field of Classification Search
CPC ..... E21B 19/10; E21B 19/004; E21B 17/01
See application file for complete search history.

(56) References Cited

U.S. PATENT DOCUMENTS 4,199,847 A * 4/1980 Owens ..... E21B 19/10 188/67
5,947,642 A * 9/1999 Teixeira ..... F16L 37/096 405/195.1

(Continued)

FOREIGN PATENT DOCUMENTS

BR PI0902469 B1 6/2019
SG 10201601701 A1 6/2016

(Continued)

*Primary Examiner* — James G Sayre
(74) *Attorney, Agent, or Firm* — Mintz, Levin, Cohn, Ferris, Glovsky and Popeo, P.C.

(57) ABSTRACT

The present invention addresses to a system for supporting the tension load of the riser, this component with the primary function of supporting the risers, where the riser support mechanism is an integral part of the upper cone, thus eliminating the need to install slips by the shallow dive, and, also avoiding that the locking mechanism is an integral part of the Top Termination of the Riser (L). There is a minimal number of moving parts, which favors the maintainability of the system. In addition, if maintenance is required, the size and weight of the components are compatible with diving operations. For pull-in operations, it is anticipated that the slips will return to their working position only by the action of the force of gravity. In the case of pull-out, the concept of automated slip retraction mechanism was developed. A new Top Termination of the Riser (TTR) (L) geometry is also proposed, aiming at its simplification, in which, in addition to considering the locking mechanism as an integral part of the upper cone of the Support Pipe, there is the elimination of moving components for stabilization of its side movement (a function formerly performed by the locking ring or by the gap compensator).

18 Claims, 9 Drawing Sheets

(56) References Cited

U.S. PATENT DOCUMENTS

| | | | | |
|---|---|---|---|---|
| 6,739,804 | B1 * | 5/2004 | Haun | E21B 19/004 405/195.1 |
| 2001/0031174 | A1 | 10/2001 | Olivier et al. | |
| 2003/0206773 | A1 * | 11/2003 | Stromberg | E21B 19/24 405/224.2 |
| 2010/0006807 | A1 * | 1/2010 | Claxton | E21B 19/004 254/133 R |
| 2013/0092386 | A1 * | 4/2013 | Gilmore | E21B 19/004 166/348 |
| 2013/0092390 | A1 * | 4/2013 | Gilmore | E21B 19/004 166/367 |

FOREIGN PATENT DOCUMENTS

| | | | | |
|---|---|---|---|---|
| WO | 2017034409 | A1 | 3/2017 | |
| WO | WO-2019232605 | A1 * | 12/2019 | B63B 21/04 |
| WO | 2021232131 | A1 | 11/2021 | |

* cited by examiner

SUPPORT FOR RISERS AND METHOD FOR COUPLING AND UNCOUPLING

CROSS-REFERENCE TO RELATED APPLICATIONS

This application is a national phase application, filed under 35 U.S.C. § 371, of PCT International Patent Application No. PCT/BR2021/050217, filed May 20, 2021, and claims benefit of and priority to Brazilian application BR 10 2020 010231 1, filed on May 21, 2020, the disclosures of all of which are incorporated herein by reference in their entirety.

FIELD OF THE INVENTION

The present invention addresses to a rigid or flexible riser interconnection component to be used in a support pipe and top termination of the riser with modified geometry, applied in the oil extraction/exploration field, mainly in floating production and storage units (FPSO: Floating Production Storage and Offloading), with the primary function of supporting rigid risers.

DESCRIPTION OF THE STATE OF THE ART

The possibility of serial manufacturing of FPSO hulls for the pre-salt pole (replicants) emphasized the need to make the support systems of the risers and production plants suitable to current designs adapted to a future reality. The generalization of the structural and operational context, in such a way as to allow that a Stationary Production Unit (SPU) could be manufactured even before the complete definition of the bottom arrangement of a production field, led to the development of a type of support pipe called Multifunction Bell Mouth (MFBM).

As for the types of risers, it is noted that the flexible riser is manufactured using superimposed layers of interlocking steel profiles, interspersed with layers of elastomeric materials, so that such conformation provides to the riser a relative flexibility compared to those in the manufacture of which rigid metallic pipes are used.

Meanwhile, the rigid riser is manufactured in rigid steel pipes, which in the interconnection between the production line and the Stationary Production Unit (SPU) assumes the conformation of a free catenary. Such risers can be supported directly on the Buoy Supporting Riser (BSR), called Steel Catenary Riser (SCR) or SCR-type risers, which use carbon steel pipes internally coated with a corrosion-resistant metallic liner.

The basic concept established for this new riser support device was that it should have the versatility to allow the use of flexible or rigid risers with some variation in their internal diameters, and that the interconnection could be carried out by port or starboard. The interface of the MFBM with the top termination of the riser depends on the technology adopted (rigid or flexible riser), with rigid risers being locked from the top and flexible risers from the bottom.

In the case of supporting flexible risers, the bend stiffener locking is performed identically to the bell mouth of the BSN300 series (U.S. Ser. No. 00/594,7642A), with the bend stiffener helmet locked by dogs and the riser tension anchored by the hang-off on the upper balcony of the FPSO.

In the case of rigid riser support, a new Top Termination of the Riser (TTR) concept was developed. The top termination of the riser has already been named in several different ways, such as "Hang-off adapter", used in the FPSO Cidade Ilhabela or as "Shank" by the applicant during a design of a multifunction bell mouth, in which the termination of the riser contains a Flexjoint (Flexible Joint) or Stressjoint in its lower part and the riser tension is anchored in the upper cone of the MFBM, this force being transmitted by slips that, in the initial development stage of the MFBM concept, would be installed by shallow diving.

The applicant's first experience with the support of rigid risers in multifunction bell mouths occurred with the interconnection in the FPSO Cidade de Ilhabela. Although this SPU does not have multifunction bell mouths, it used a support pipe with the same profile as a MFBM.

During the detailing of the hang-off adapter for the FPSO Cidade de Ilhabela, some complications were observed for the design that were not identified during the conceptual phase of development of the MFBM. The first prohibitive issue, requiring modification of the invention, was the finding that, for safety reasons, the diver could not install the slips, as his hand would be positioned between the MFBM and the riser stressed by the pull-in cable; such a situation is considered to be an unacceptable risk.

The solution found for this problem was the development of hinged slips by the charterer of the FPSO Cidade de Ilhabela (SBM—WO2017/034409 A1). However, this solution cannot be effectively applied to replicant FPSOs, as this device, in addition to being protected by an SBM patent, has dimensions that are incompatible with the replicant risers support balcony, which has a very restricted space for installing the MFBM.

Another important point, observed during the interconnection of rigid risers to the FPSO Cidade de Ilhabela, was that the compensator gap system, which corresponds to the "locking ring" in the original MFBM concept, despite being capable of side locking the hang-off adapter, thus allowing transmission of the shear force coming from the riser, does not guarantee complete suppression of riser installation misalignment.

By analyzing all the restrictions observed during the detailing of the hang-off adapter for the FPSO Cidade de Ilhabela, the applicant developed a new termination concept. To this end, the support slips were considered as integral elements of the hang-off adapter (HOA-BR), thus avoiding the use of diving for its installation. A lower locking slip system was also planned, replacing the "locking ring" of the original concept.

Although considered a viable solution, the HOA-BR concept was discontinued because it had too many moving parts and would require a lot of detailed engineering, such as, for example, defining the hydraulic system to drive the upper slips. Based on the disclosure above, there was identified the need of adapting the design of the support pipe device to make this equipment more conducive to pull-in operations of rigid risers.

Document PI0902469B1 discloses a multi-angle support system for connecting a riser on the flank of oil production units, which comprises at least one support capable of fixing a riser to the side of a stationary production unit (SPU), and more especially in FPSOs, at a determined angle of arrival, and also offer the possibility of alternative combinations of arrangements that make possible having a variation of angles of arrival of the flexible or rigid riser, in any setting situation that may arise during the lifetime of a SPU. The document differs from the present invention in that it does not show significant changes in the support pipe and does not disclose geometric modifications in the top termination of the riser that simplify the equipment.

Document SG10201601701A1 discloses an apparatus for coupling a riser to a flowline, especially when coupled to the side or to a tower of a floating storage or production vessel (FPSO). In particular, the present invention concerns a bell mouth that can be used for various types of risers. The document does not make reference to the geometric modifications in the top termination of the riser nor to the rigid riser support mechanism being an integral part of the upper cone.

Document WO2017034409A1 discloses a superior locking system for a riser in support of floating platforms (FPSO). The riser pipe is inserted into the support pipe and mounted on a suspended support pipe. The upper locking system includes a plurality of hinged slips arranged where each hinged slip of the upper locking system is rotatably movable from an open position to a closed position. The hinged slips are at the Top Termination of the Riser; however, in the present invention, the hinged slips are an integral part of the upper cone of the bell mouth, thus eliminating the need of installing slips by shallow diving.

The present invention addresses to a rigid riser support with different features that provide advantages over what is disclosed by documents of the state of the art.

BRIEF DESCRIPTION OF THE INVENTION

The present invention addresses to a riser interconnection component to be used in a Support Pipe type device, focused on the replacement/innovation of the upper part, this component with the primary function of supporting the rigid riser. Although the present invention is directed to the support of rigid risers, it could be easily adapted to also support flexible risers, and the present invention is also adaptable to any device of the Support Pipe type.

Unlike the original concept of the MFBM-type Support Pipe device, here the premise was adopted that the rigid riser support mechanism is an integral part of the upper cone, thus eliminating the need to install slips by shallow diving and avoiding also ensure that the locking mechanism is an integral part of the Top Termination of the Riser (TTR). Another important point is that there is a minimum number of moving parts, which favors the maintainability of the system. In addition, should maintenance be required, the size and weight of the components are compatible with diving operations.

For pull-in operations, it is expected that the slips will return to their working position only by the action of the force of gravity. In addition, all mechanism components are compatible with the expected contact force with a pull-in cable.

In the case of pull-out, the concept of automated slip retraction mechanism was developed. The foundation of this concept lies in the mechanism bars that interconnect all the slips of the upper cone, making the assembled mechanism have only one degree of freedom: the joint retraction of all the slips. It should be emphasized that there is no impediment for this automated retraction mechanism to be used in pull-in operations as well.

It should further be emphasized that the automated retraction mechanism of the slips can be used as an alternative option to the effect of gravity. If any effect is identified that casts doubt on the already-presented functional description (e.g., corrosion or growth of marine life), the mechanism can be adopted as a guarantee that the slips will move to the desired positions—retraction and extension—during the pull-in operation.

A new Top Termination of the Riser (TTR) geometry is also proposed, aiming at its simplification, in which, in addition to considering the locking mechanism as an integral part of the upper cone of the Support Pipe type device, there is the elimination of moving components for stabilizing its side movement (a function previously performed by the locking ring or the gap compensator).

Objectives

The present invention has as purpose to support risers.

The present invention has as objective to eliminate the need of installing slips by shallow diving.

The present invention has as objective to provide a new Top Termination of the Riser (TTR) geometry aiming at its simplification.

The present invention has as objective to prevent the locking mechanism from being an integral part of the TTR.

The present invention has as objective to reduce the number of moving parts to favor the maintainability of the system.

The present invention has as objective to ensure that the size and weight of the components are compatible with diving operations.

These and other objectives, such as flexible riser support, will be achieved by the object of the present invention.

BRIEF DESCRIPTION OF THE DRAWINGS

The present invention will be described in more detail below, with reference to the attached figures which, in a schematic way and not limiting the inventive scope, represent examples of the same. In the drawings, there are.

DETAILED DESCRIPTION OF THE INVENTION

Figure 1:
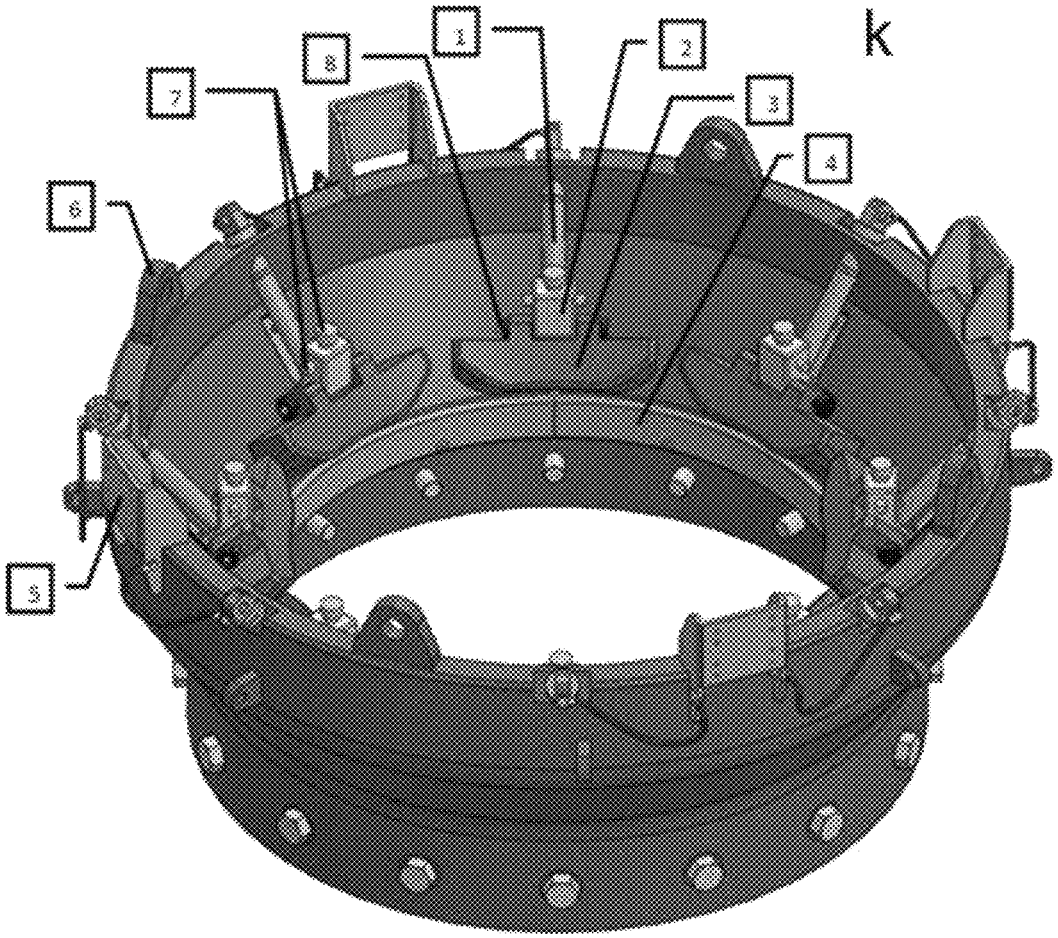
FIG. 1 illustrating an overview of the upper cone and rigid riser support components.
Figure 2:
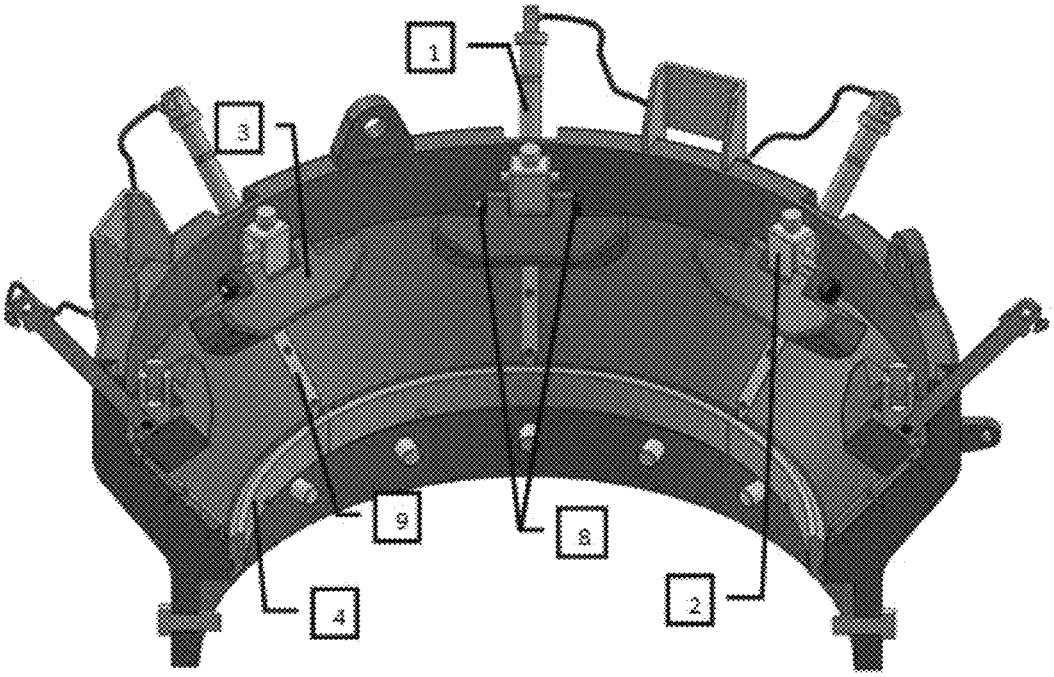
FIG. 2 illustrating the section view of the upper cone.

The rigid riser support has the following components:

Axle (1);

Fork (2);

Slip (3);

Wear bushing (4);
Support for camera (5);
Cone eyelet (6);
Antifouling pins (7);
Union pin (8);
Rail (9);
Pin for retraction bar (10);
Clamp (11);
Alternatively, there may be a slip retraction mechanism bar (12), axle extender (14) and slip retraction tool (15) installed for the pull-out step (or, if necessary, for the pull-in);
Eyelet for slip retraction mechanism tool (13); Backup eyelet for slip retraction (16).

The axle (1) is the component with the primary guide function for the retraction and extension of the slips (3) during pull-in/pull-out operations. Upon observing its geometry, it is noted that its thickest part defines its end-of-stroke position. An eyelet (16) was added in this thicker region to serve as a pulling point for retracting the slips (3). The axle has a groove, easily seen by cameras installed on the support (5) or ROV, which indicates sufficient retraction of the slip (3) to release the TTR (L) in a pull-out operation.

The slip (3) is an effective component of tension load support of the rigid riser. During pull-in operations, there is contact between the pull-in cable and the slips (3), which retract without resistance. In order to avoid damage to the pull-in cable or to the slip itself (3) in this contact, the surfaces facing the axial direction of the system are rounded/faired.

Figure 3:
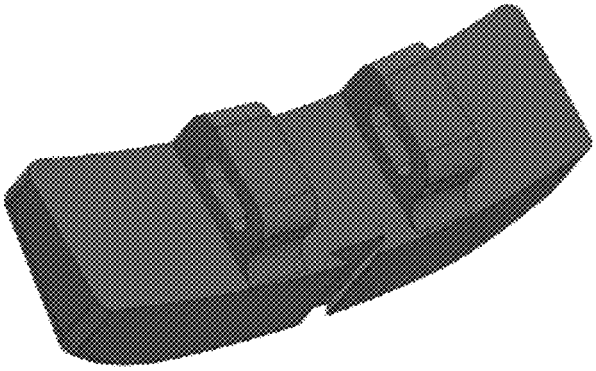
FIG. 3 illustrating the detail of the slip groove, used as a secondary guide.
Figure 4:
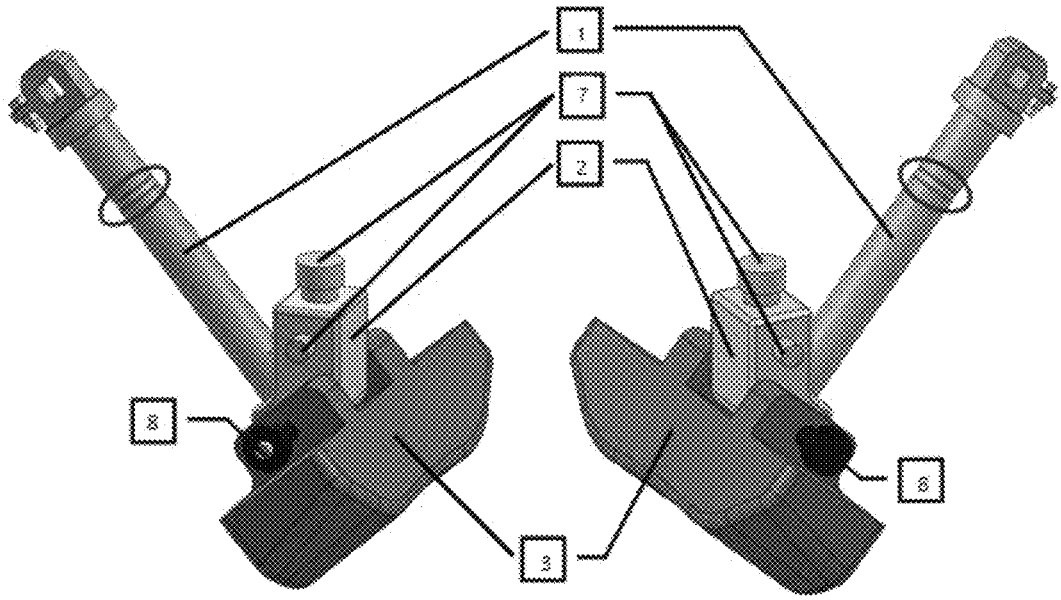
FIG. 4 illustrating the axle (1), fork (2) and slip (3) assembly and detail of the chamfer on the axle.
Figure 5:
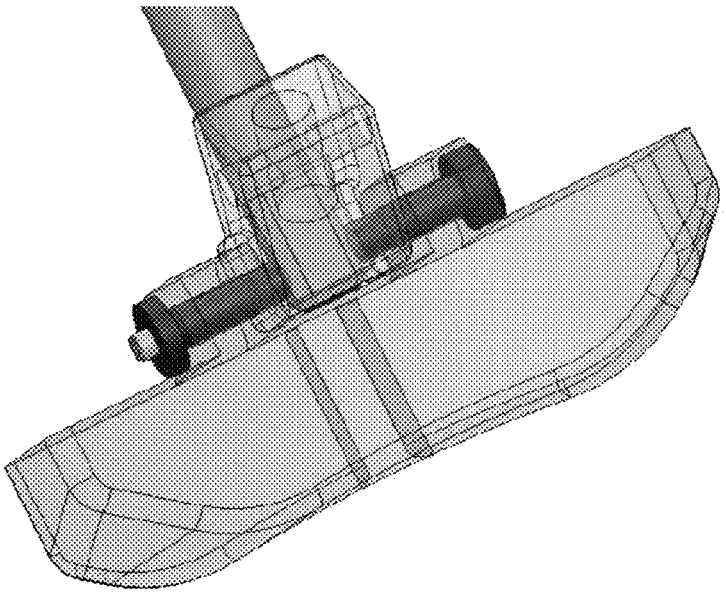
FIG. 5 illustrating the detail of the union pin for the coupling between the axle, fork and slip.

In order that side loads do not occur, the rail (9) serves as a secondary guide during the contact with the pull-in cable, as it acts together with the slip groove (FIG. 3) as a reaction surface for side loads, avoiding axle (1) warping and consequent locking of the system.

The fork (2), an item necessary only for installing the retraction tool, is located between the axle (1) and the slip (3) and has a hole for installing the retraction tool (10 and 12) (pin and bar) for joint retraction of the slips (3).

The union pin (8) is the component responsible for the coupling between the axle (1), the slip (3) and the fork (2).

The cone eyelet (6) is the component used to lift the upper cone (k).

The antifouling pins (7) are the components used to protect against incrustation of the holes in the fork where the retraction tool pins (10) and the respective clamps (11) will enter.

The wear bushing (4) is the component responsible for mitigating wear on the upper cone (k). During the installation of the rigid riser, the pull-in cable will come into contact with the upper cone (k), which could cause damage to the upper cone (k). The wear bushing (4) is a component whose geometry presents itself as a preferential point of contact with the pull-in cable, and its wear is foreseen in the design and does not impact the structural strength and the functioning of the mechanisms.

The backup eyelet for slip retraction (16) is the axle eyelet (1) that can be used for its movement in case of failure of the main unlocking system, and the slip retraction tool (15) is coupled to the slip retraction mechanism eyelet (13), which, in turn, is connected to the axle extender (14).

Figure 8:
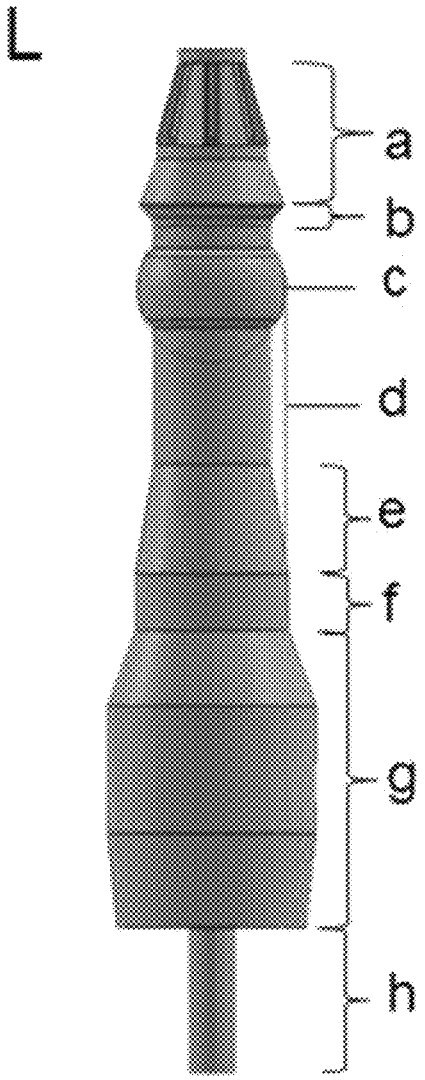
FIG. 8 illustrating the geometry of the TTR.

Aiming at simplification, a new geometry was developed for the TTR (L), as can be seen in FIG. 8, which, in addition to considering the locking mechanism as an integral part of the upper cone of the support pipe (k), there is the elimination of moving components to stabilize its side movement. The new configuration consists of the following regions:

Riser pre-alignment profile (a);
Slip support region (b);
Spherical geometry (c) for initial TTR entry (L);
Hourglass shape (d) for minimization of pull-in forces;
Tapered surface for gap suppression & final alignment (e);
Cylindrical surface (f) for transmission of shear force to the Support Pipe;
Rigidity transition device between the riser and the TTR (L), such as a Flexjoint (illustrative example in the figure), Stressjoint, etc. (g);
Riser extension connected to Flexjoint (h).

Figure 9:
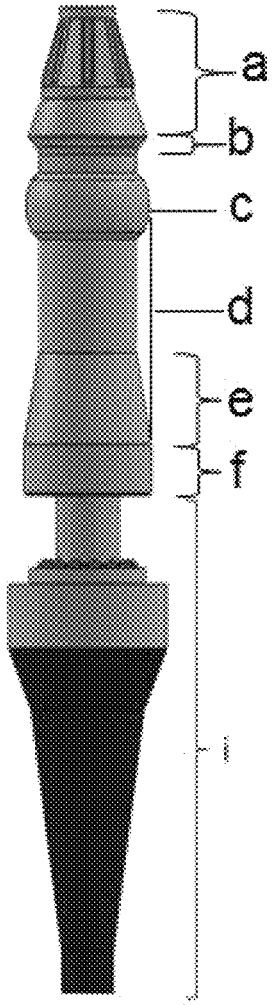
FIG. 9 illustrating the TTR geometry adapted to support flexible risers.
Figure 10:
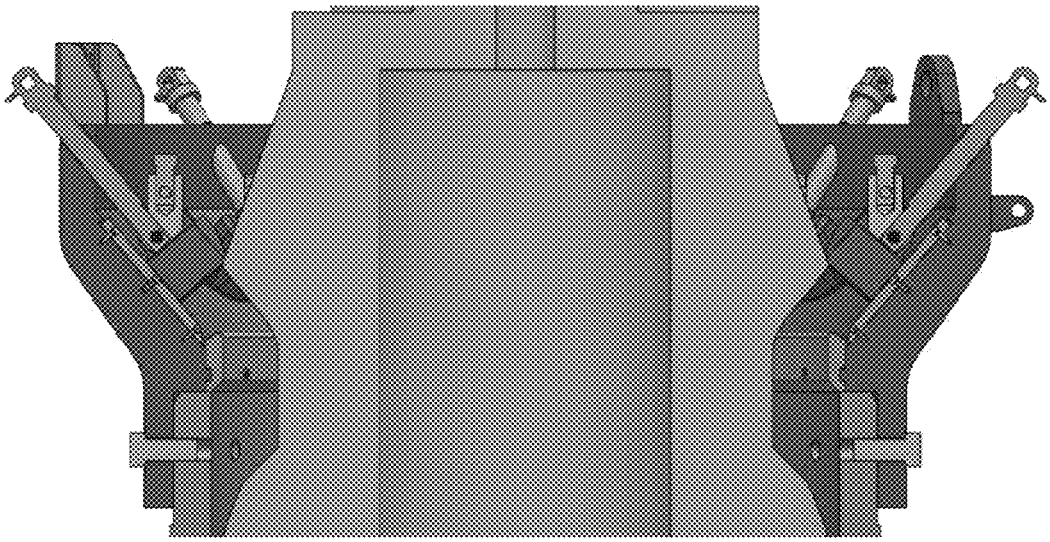
FIG. 10 illustrating the beginning of the upward movement of the slip/fork/axle assemblies.
Figure 11:
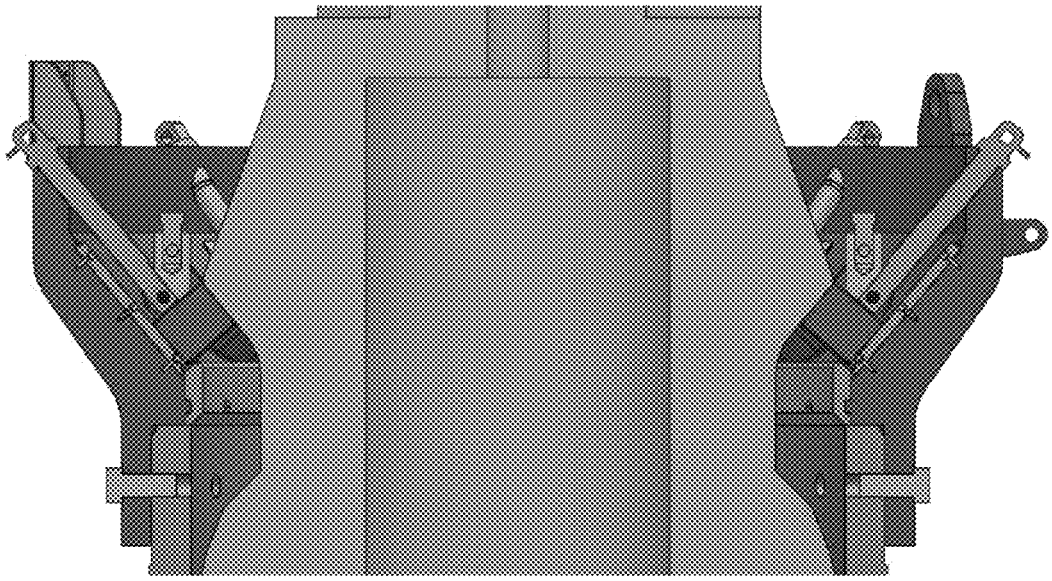
FIG. 11 illustrating the end of the downward movement of the slip/fork/axle assembly.

The regions described above describe the TTR (L) solution for rigid riser support. The TTR (L) can be easily adapted to support flexible risers by replacing components (g) and (h) with a curvature stiffener (i), a component typically used to provide protection for flexible risers, as can be seen in FIG. 9.

The riser pre-alignment profile (a) is the transition region between the small diameter of the TTR flange (L) connected to the tension head for riser pull-in and the slips support region (b), being necessary to carry out a smooth pre-alignment of the riser in the Support Pipe, eliminating the risk of overloads in the pull-in system.

The slips support region (b) contains the surface that effectively supports the tension load of the riser, presenting the angle compatible with the slips (3) of the upper cone (k). The fundamental premise is that, whatever the demand coming from the riser is, the contact pressure between the TTR (L) and the slips (3) of the upper cone (k) can even be slowed down, but not suppressed to the point that the contact between the top termination of the riser (L) and its support system is ceased.

The spherical geometry (c) for the entry of the TTR (L), although the first contact region of the TTR (L) with the support pipe is precisely the edge of the slips support region (b), has a larger diameter, thus being the main surface of initial contact between the top termination of the riser (L) and the support. As it is spherical, whatever the installation misalignment, the contact condition of the TTR (L) with the support pipe is quite homogeneous, thus acting as a "ball joint" for the initial entry of the riser.

The hourglass-shaped region (d) allows a misaligned insertion of the TTR (L) in almost its entire length, allowing the spherical region (c) to effectively act as a ball joint, thus avoiding the appearance of large resistive forces to the pull-in operation. It is located below the spherical region (c), where there is a portion of the TTR (L) with a diameter significantly smaller than the internal diameter of the support pipe.

After the almost complete entry of the TTR (L) into the support pipe, the gap provided by the hourglass-shaped region (d) needs to be suppressed in this region called the Conical Surface for Gap Suppression (e), to align the support region of the TTR (L) with the support slips (3) of the upper cone (k) and promote the effective alignment between the TTR (L) and the Support Pipe.

The cylindrical surface for transmitting the shear force (f) is the last element of the TTR (L) to come into contact with the Support Pipe, thus ending the pull-in operation. As the spherical geometry (c) and the cylindrical surface (f) present a tight tolerance in relation to the internal diameter of the Support Pipe, the combination of such manufacturing requirements establishes a high self-alignment capacity of the TTR (L). A great advantage of the tight tolerance of this cylindrical surface is the elimination of the need of including a movable component for suppressing the gap and for transmitting the shear force coming from the riser.

The coupling method (pull-in) starts with the entry of the TTR (L) in the Support Pipe, where it is pre-aligned. The contact of the spherical geometry (c) of the TTR (L) then begins, creating the first resistant torque to the entry of the TTR (L) in the Support Pipe. From there, it can be noted that the conical surface of the TTR (L) is in contact with the Support Pipe, in order to eliminate the gap between the two of them and the consequent alignment and centralization of the TTR (L) inside the Support Pipe. With the TTR (L) already centered on the Support Pipe, it approaches the contact with the slips (3). The TTR (L) starts touching the slips (3), pushing them upwards together with the slip (3)/fork (2)/axle (1) assembly. After the end of the upward movement of the slip (3)/fork (2)/axle (1) assemblies, it descends due to the effect of gravity acceleration after losing contact with the TTR (L), and the slips (3) move down. After completing the downward movement, the TTR (L) is lowered and is completely supported by the slips (3).

Alternatively, the retraction mechanism (12) of the slips (3) can be used for the final pull-in step described in the previous paragraph. That is, the step of touching the TTR (L) on the slips (3) is replaced by a previous retraction of the slips (3) using the retraction mechanism (12). After the end of the upward movement of the TTR (L), the retraction tool (15) is activated in the opposite direction to extend the slips (3) and allow the final seating of the TTR (L).

Figure 6:
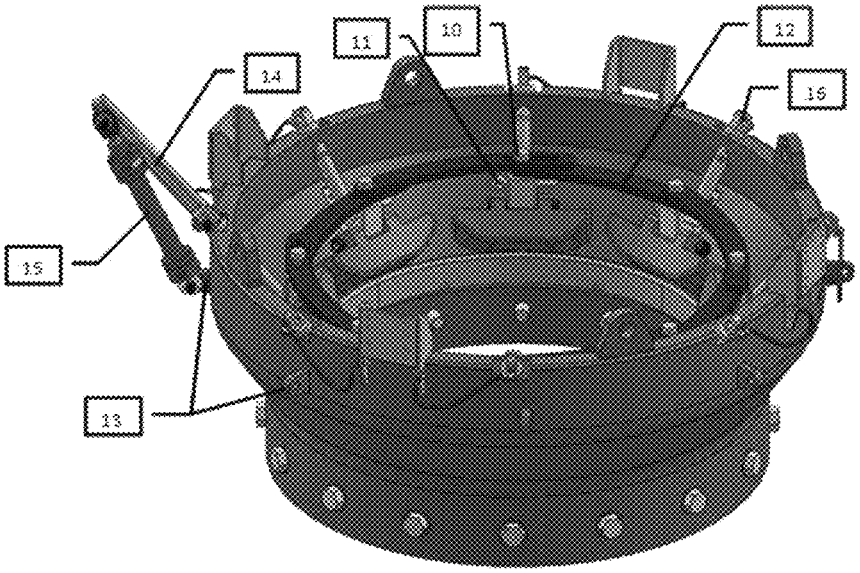
FIG. 6 illustrating the automated retraction mechanism of the slips.
Figure 7:
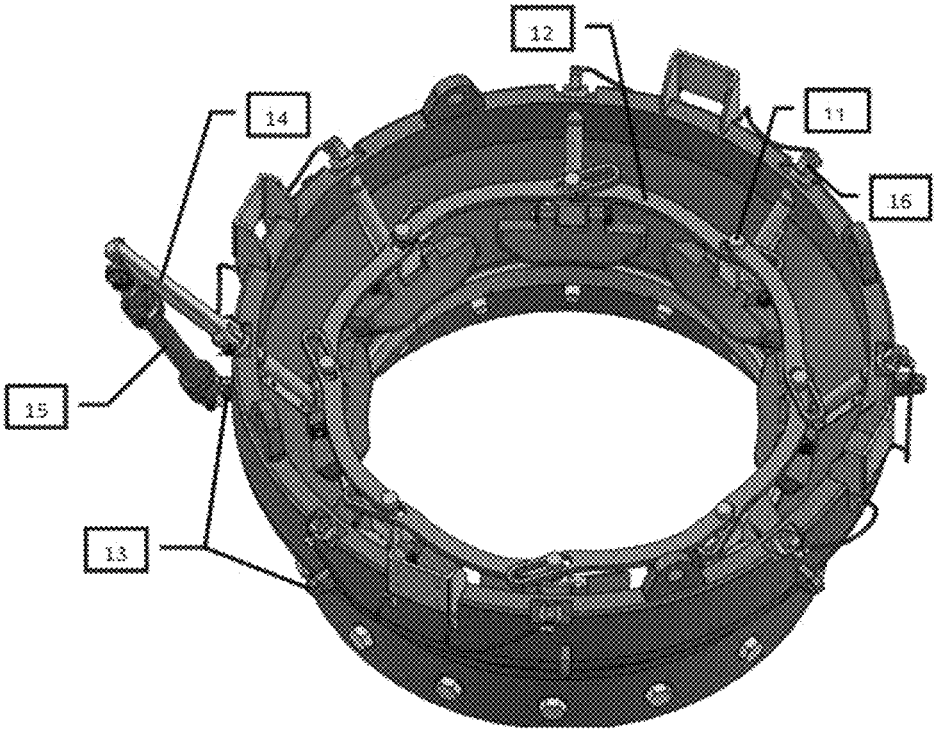
FIG. 7 illustrating the automated retraction mechanism of the slips.
Figure 12:
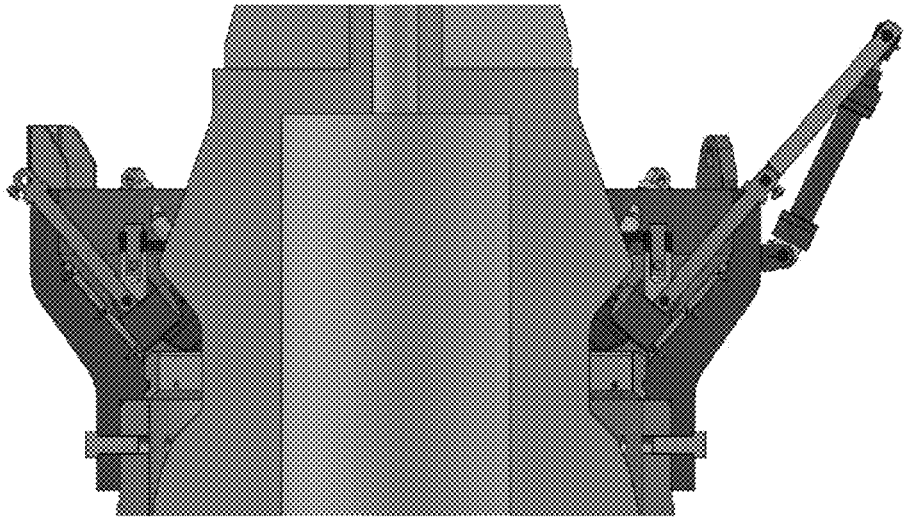
FIG. 12 illustrating the TTR after being pulled, losing contact with the slips.
Figure 13:
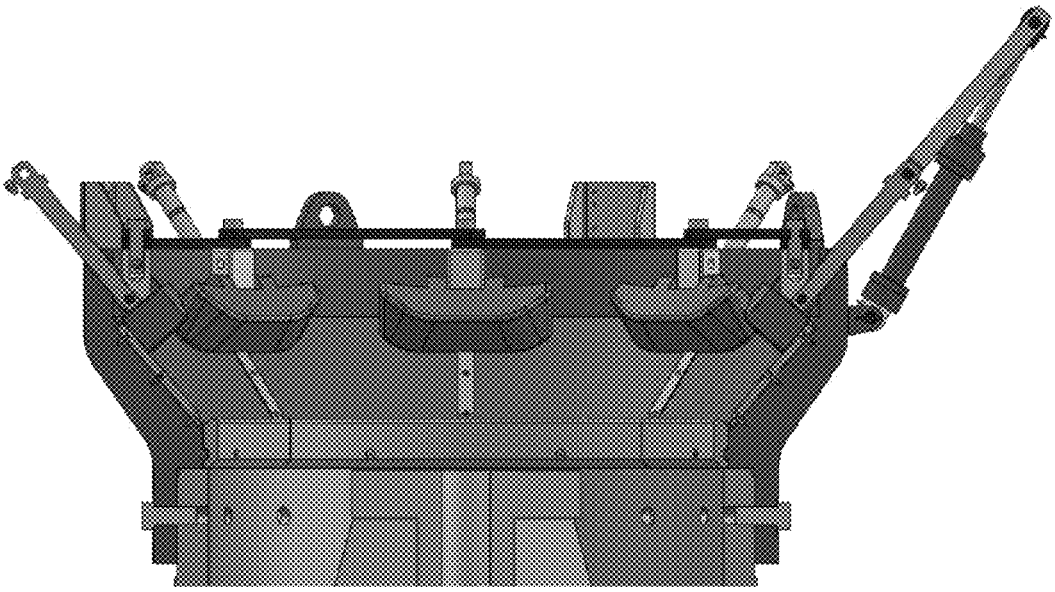
FIG. 13 illustrating the total retraction of the slips and consequent removal of the TTR.
Figure 14:
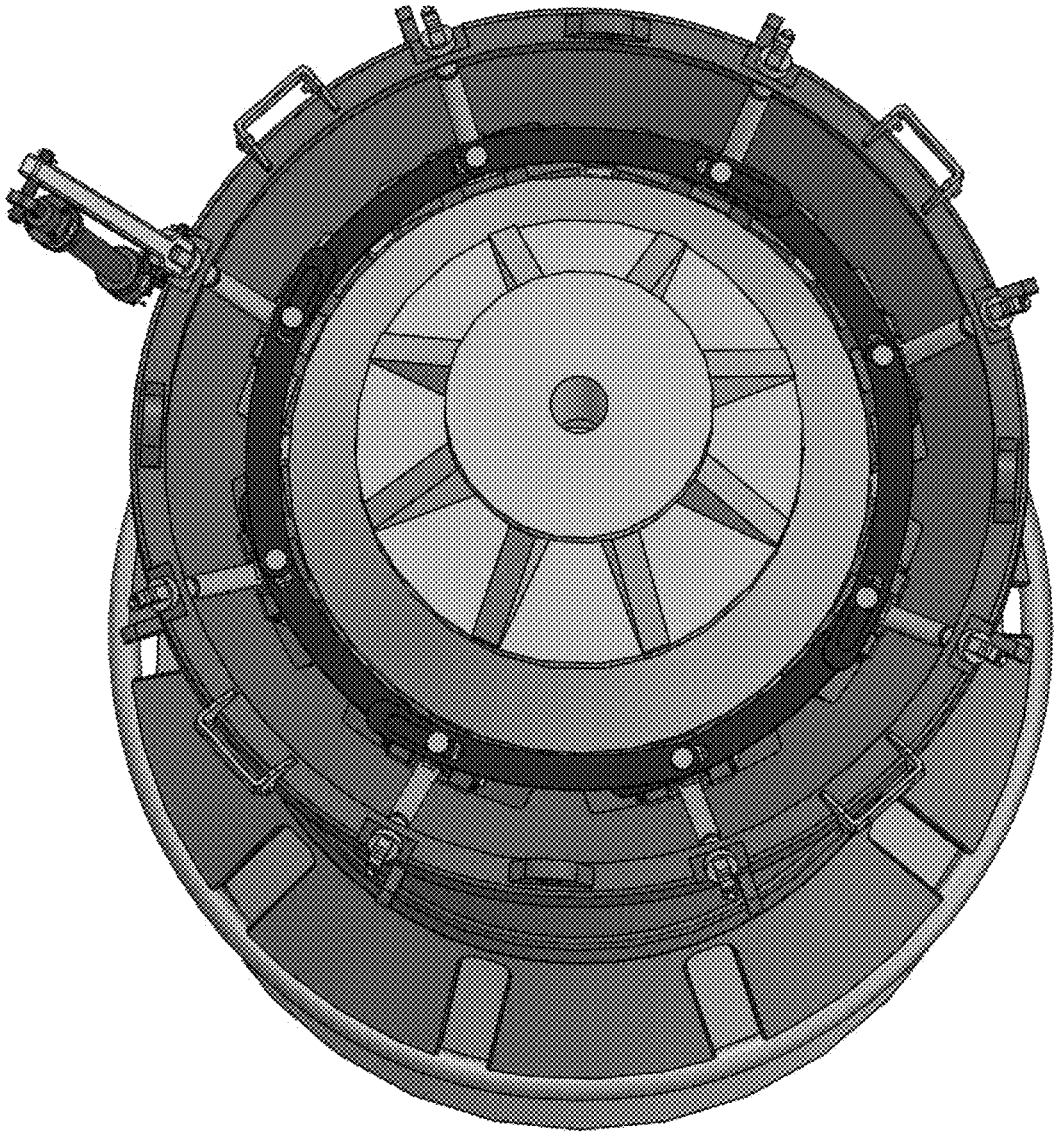
FIG. 14 illustrating the automated retraction mechanism of the slips.

For the uncoupling method (pull-out), it is necessary to install the automated slip retraction mechanism (3), whose main components are: slip retraction mechanism bars (12), axle extender (14) and slip retraction tool (15), as can be seen in FIGS. 6, 7 and 13. After installing the Automated Retraction Mechanism, it is necessary to raise the TTR (L) so that it is no longer resting on the slips (3), over-pull position, FIG. 12. The next step is for the retraction tool (15) of the slips (3) to act on the axle extender (14) so that the axle (1)/slip (3)/fork (2) assembly, on which the extender (14) is attached, starts to be retracted. With this movement, all retraction bars (12) of the slips begin to move due to kinematic restrictions, thus retracting the other slip (3)/fork (2)/axle (1) assemblies. Next, the TTR (L) can be lowered and removed from the upper cone (k), FIG. 13.

It should be noted that, although the present invention has been described in relation to the attached drawings, it may undergo modifications and adaptations by technicians skilled on the subject, depending on the specific situation, but provided that it is within the inventive scope defined herein.

The invention claimed is:

1. A support for risers, the support comprising:

a riser interconnection component in at least one pipe support with a rigid riser support mechanism as an integral part of an upper cone; and a top termination of the riser (TTR) with no moving components;

wherein the upper cone of the pipe support comprises:

an axle;

a fork;

slips;

wear bushing;

support for camera;

cone eyelet;

antifouling pins;

union pin;

rail;

pin for retraction bar;

clamp, eyelet for slip retraction mechanism tool; and backup eyelet for slip retraction.

2. The support for risers according to claim 1, wherein the axle has a groove indicating sufficient retraction of the slip.

3. The support for risers according to claim 1, further comprising:

a slip retraction mechanism bar;

an axle extender; and a tool installed and used to retract the slips.

4. The support for risers according to claim 1, wherein the slips are rounded/faired on a surface that comes into contact with a pull-in cable.

5. The support for risers according to claim 1, wherein the fork (2) has a hole for installing the retraction tool comprising a a pin and a bar.

6. The support for risers according to claim 1, characterized in that the union pin couples the axle, the slip, and the fork.

7. The support for risers according to claim 1, wherein a wear bushing is a point of contact with a pull-in cable and mitigating wear on the upper cone.

8. A support for risers, the support comprising:

a riser interconnection component in at least one pipe support with a rigid riser support mechanism as an integral part of an upper cone; and a top termination of the riser (TTR) with no moving components, the top termination of the riser comprising:

a riser pre-alignment profile;

a slips support region;

a spherical geometry region for initial TTR entry;

an hourglass-shaped region for minimization of pull-in forces;

a conical surface for gap suppression & final alignment; and a cylindrical surface for transmission of shear force to the pipe support and a stiffness transition device between a riser extension and the TTR.

9. The support for risers according to claim 8, further comprising a curvature stiffener, replacing the components and the riser extension to support a flexible riser.

10. The support for risers according to claim 8, wherein a riser pre-alignment profile eliminates a risk of overloads in a pull-in system and smoothly aligns the riser in the pipe support.

11. The support for risers according to claim 8, wherein a slips support region comprises a surface that effectively supports a tension load of the riser, presenting an angle compatible with the slips of the upper cone.

12. The support for risers according to claim 8, wherein the spherical geometry for the entry of the TTR presents spherical geometry, a diameter greater than a support edge of the slips and is the main surface of initial contact between the top termination of the riser and the support.

13. The support for risers according to claim 8, wherein the spherical geometry for the entry of the TTR is configured to act as a ball joint for an initial entry of the riser.

14. The support for risers according to claim 8, wherein the hourglass-shaped region is located below a spherical region and allows misaligned insertion of the TTR.

15. The support for risers according to claim 8, wherein the conical surface for gap suppression suppresses the gap provided by the hourglass-shaped region after the entry of the TTR in the pipe support and aligns the TTR with the pipe support.

16. The support for risers according to claim 8, wherein the cylindrical surface for transmission of shear force is located below the conical surface for gap suppression and is the last element to come into contact with the Pipe Support.

17. A coupling method comprising:

inserting a top termination of a riser (TTR) into a support pipe in an upward movement;

contacting a spherical geometry of the TTR on the support pipe and creating a first torque resistant to entry;

starting contacting a conical surface of the TTR with the support pipe;

centering the TTR on the support pipe;

touching the TTR in slips and pushing them upwards together with a slip/fork and axle assembly;

finishing the upward movement of the slip/fork axle assembly and descending the same by gravity after contact with the TTR ends;

finishing a downward movement of the slip/fork/axle assembly; and lowering the TTR completely and rest it on the slips.

18. A decoupling method comprising:

installing a slip retraction mechanism comprising a slip retraction mechanism bar, an axle extender, and a slip retraction tool;

raising a top termination of a riser (TTR) to an over-pull position;

retracting a slip/fork/axle assembly using an unlocking tool acting on the axle extender; and lowering and removing the TTR.

* * * * *